US005153088A

United States Patent [19]

Muto et al.

[11] Patent Number: 5,153,088

[45] Date of Patent: Oct. 6, 1992

[54] ELECTROPHOTOSENSITIVE MATERIAL WITH X-TYPE METAL FREE PHTHALOCYANINE AND PERYLENE COMPOUND

[75] Inventors: Nariaki Muto, Daito; Tatsuo Maeda, Kobe; Hirotsugu Nishikawa, Osaka; Mikio Kakui, Mino; Keisuke Sumida, Hirakata; Toru Nakazawa, Osaka, all of Japan

[73] Assignee: Mita Industrial Co., Ltd., Osaka, Japan

[21] Appl. No.: 485,320

[22] Filed: Feb. 28, 1990

[30] Foreign Application Priority Data

Feb. 28, 1989 [JP] Japan ..... 1-49106
Feb. 28, 1989 [JP] Japan ..... 1-49107

[51] Int. Cl.[5] ..... G03G 5/09; G03G 5/06
[52] U.S. Cl. ..... 430/78; 430/83
[58] Field of Search ..... 430/78, 83

[56] References Cited

U.S. PATENT DOCUMENTS 3,992,205 11/1976 Wiedemann ..... 430/78 X
4,514,482 4/1985 Loutfy et al. ..... 430/78
4,524,118 6/1985 Nakatani et al. ..... 430/83 X
4,555,463 11/1985 Hor et al. ..... 430/59
4,556,622 12/1985 Neumann et al. ..... 430/83 X
4,755,443 7/1988 Suzuki et al. ..... 430/58
4,877,702 10/1989 Miyamoto et al. ..... 430/72
4,882,254 11/1989 Loutfy et al. ..... 430/83 X

FOREIGN PATENT DOCUMENTS 0314195 5/1989 European Pat. Off. .
188152 8/1988 Japan ..... 430/78

*Primary Examiner*—Roland Martin

*Attorney, Agent, or Firm*—Beveridge, DeGrandi & Weilacher

[57] ABSTRACT

This invention provides an electrophotosensitive material comprising a conductive substrate and a photosensitive layer formed thereon, the photosensitive layer includes a perylene compound (I) and an X-type metal-free phtalocyanine as a charge-generating ingredient and a diamine derivative (II) as a charge-transferring ingredient in the binding resin. This electrophotosensitive material is especially superior in sensitivity and reproductivity. Formulas (I) and (II) are defined as follows:

(I)

(II)

wherein $R^1$, $R^2$, $R^3$, $R^4$, $R^5$, $R^6$, $R^7$, $R^8$, $R^9$ l, m, n, o and p have the same meanings as defined in the text of the specification.

26 Claims, No Drawings

ELECTROPHOTOSENSITIVE MATERIAL WITH X-TYPE METAL FREE PHTHALOCYANINE AND PERYLENE COMPOUND

BACKGROUND OF THE INVENTION

The present invention relates to an electrophotosensitive material. More particularly the invention relates to the electrophotosensitive materials ideally utilized for the picture imaging apparatus such as copying machine.

Recently, an organic photosensitive materials are utilized for the electrophotosensitive material because the organic layer have wide freedom for the functional designing as well as workability and advantageous in production costs. It is well known that the high sensitive functional types electrophotosensitive material provides a photosensitive layer wherein the electric charge generating with exposuring to light function with a charge-generating ingredient and the electric charge-transferring function with a charge-transferring ingredient which ingredients are separated functions type photosensitive material as the organic photosensitive material.

There are variety of photosensitive layers which materials are functional parted electrophotosensitive material wherein comprising charge-generating layer at least contained with a charge-generating ingredient and charge-transferring layer at least contained with a charge-transferring ingredient and a binding resin, and photosensitive single type layer wherein both of a charge-generating ingredient and a charge-transferring ingredient are dispersed into a solvent thereof.

The photosensitive material wherein providing photosensitive multilayer have an advantageous in providing a high sensitivity and wide availability for selecting photosensitive material, because the functions thereof are separated into two, the charge-generating layer and the charge-transferring layer. layer.

Generally the negative electrificated photosensitive multilayer is structured as the conductive substrate is coated with charge-generating ingredient, and charge-transferring layer is further coated thereonto, because major charge-transferring layer is positive hole transfer type and giving durability to the surface is also required. However, those photosensitive multilayers for negative electrification may generate ozone into the ambient atmosphere, causing the sensitive layer, on negative electrified, to deteriorate and autotyping environment to contaminate, and the positive charged toner which is difficult to make, is necessary in developing prosess.

On the other side, it is recognized that the single layer type photosensitive material is not only charge positive but able to use negative charge toner to develop electrostatic latent image in the photosensitive layer, it is advantageous in widely selecting toner for the preparation, however, both of electron and positive hole are moved in one layer wherein either electron or positive hole are trapped, causing the residual potential to increase. Moreover, it is yet a question that electrophotographic characteristics such as the electrification characteristics, the sensitivity and the residual potential depend much up on the combination of charge-generating ingredient and charge-transferring ingredient.

In consideration of the problem abovementioned, the experiments to increase sensitivity of a single layer type photosensitive material are proposed in; An electrophotosensitive material comprising perylene pigment such as N,N'-dimethylperylene-3,4,9,10-tetracarboxydiimido and N,N'-di(3,5-dimethylphenyl)-perylene-3,4,9,10-tetracarboxydiimido as charge-generating ingredient, binding resin and acetonaphthylene as sensitizer, JP, A. No. 76840/1983, and an electrophotosensitive material comprising the perylene type pigment, polyvinylcarba sole resin as charge-transferring ingredient and terphenyl as sensitizer, JP,A. No. 119356/1984.

However, the these electrophotosensitive material are not yet complete to obtain the sufficient sensitivity. Especially, because of the perylene compound wherein having no spectrosensitivity to the long wave-length side, the charge-generating layer containing such a perylene compound yet result in obtaining insufficient sensitivity if it is combined with a halogen lamp of large spectro-energy for red.

SUMMARY OF THE INVENTION

It is an object of the present invention to provide a high sensitive single layer type electrophotosensitive material by finding out a combination of the material to satisfy the special features necessary for the electrophotosensitive material.

It is a further object of this invention to provide the single layer type electrophotosensitive material superior in reproducibility.

The present invention contemplates the provision of the electrophotosensitive materials wherein forming a photosensitive layer on a conductive substrate.

The photosensitive layer comprises the perylene compound as the charge-generating material, diamine derivative as charge-transferring material and X-type metal-free phthalocyanine.

An elecrophotosensitive material comprising a conductive substrate and a photosensitive layer formed thereon, the photosensitive layer containing a charge-generating ingredient and a charge-transferring ingredient in a binding resin, the charge-generating ingredient being a perylene compound represented by the following general formula (I):

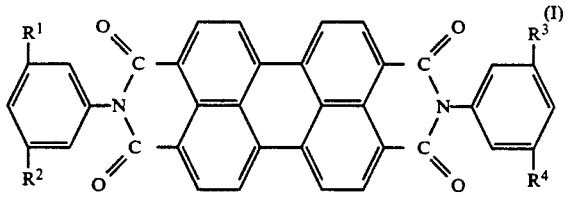

wherein $R^1$, $R^2$, $R^3$ and $R^4$ are the same or different, lower alkyl group, substituent, and X-type metal-free phthalocyanine, the charge-trasferring ingredient being a diamine derivative represented by the following general formula (II):

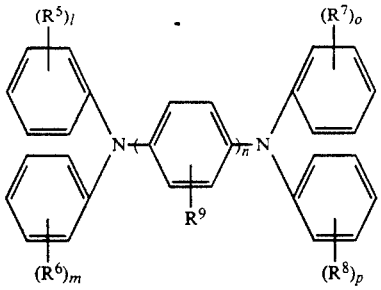

(II)

wherein $R^5$, $R^6$, $R^7$, $R^8$ and $R^9$ are the same or different, hydrogen atom, lower alkyl group, lower alkoxy group or halogen atom, n is an integer from 1 to 3, l, m, o and p are respectively an interger from 0 to 2, at least one selected from the group consisting of following groups:

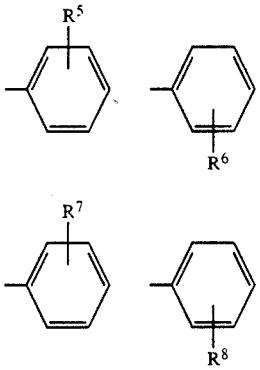

may form a condensed ring with benzen ring which may have a lower alkyl group, lower alkoxy group or halogen atom as the substituent.

The electrophotosensitive material of claim 1 wherein the photosensitive layer contains X-type metal-free phthalocyanine at a rate of 1.25 to 3.75 parts by weight to 100 parts by weight of the perylene compound.

It has been found by the inventers who applied themselves colsely to the research that diamin derivatives represented by the general formula (II) as charge-generating material has good compatibility with the binding resin and small electric field strengh dependency for drift movability, and the positive-charging single layer type electrophotosensitive material combined with above mentioned diamine derivatives used as charge-transferring material and perylene type compound used as chage-generating material represented by the general formula (I) to to disperse in binding resin is excel in charging property, sensitivity and residual potential. Furthermore, it is preferable to add X-type metal-free phthalocyanine as spectro-sensitizer into the photosensitive material in the renge of 1.25 to 3.75 parts by weight of X-type metal-free phthalocyanine to 100 parts by weight of perylene compound contained therein, which operation clears that the ranges of spectrosensitive shift to the long wave-length side and sensitivity of the sensitive layer becomes high.

The ratio of X-type metal-free phthalocyanine added thereinto is if less than 1.25 parts by weight to 100 parts by weight of perylene compound, no effects is obtained for increasing sensivity to long wave-length side, and if the retio exceed 3.75 parts by weight to 100 parts by weight of perylene compound, the spectrosensivity becomes high in the long wavelength side and the performance of copying red-color become low.

In the diamine derivative represented by general formula (II) of the invention, most preferable compound is represented by general formula (III):

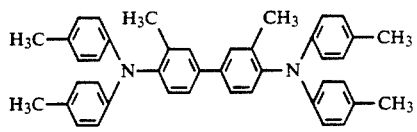

(III)

which increase the reproducibity thereof as well as the special features set forth in the above.

DETAILED DESCRIPTION

The charge-generating ingredient applied in the embodiment of the invention is certain perylene compound represented by the general formula (I) set forth in the above, wherein $R^1$, $R^2$, $R^3$ and $R^4$ are alkyl group having 1 to 6 carbon atoms such as methyl, ethyl, propyl, isopropyl, butyl, isobutyl, tert-butyl, penthyl and hexyl, and representative examples of the perylene compound is;

N,N'-di(3,5-dimethylphenyl)perylene-3,4,9,10-tetracarboxydiimido,

N,N'-di(3-methyl-5-ethylphenyl)perylene-3,4,9,10-tetracarboxydiimido,

N,N'-di(3,5-diethylphenyl)perylene-3,4,9,10-tetracarboxydiimido,

N,N'-di(3,5-dipropylphenyl)perylene-3,4,9,10-tetracarboxydiimido,

N,N'-di(3,5-diisopropylphenyl)perylene-3,4,9,10-tetracarboxydiimido,

N,N'-di(3-methyl-5-isopropylphenyl)perylene-3,4,9,10-tetracarboxydiimido,

N,N'-di(3,5-dibutylphenyl)perylene-3,4,9,10-tetracarboxydiimido,

N,N'-di(3,5-di-tert-butylphenyl)perylene-3,4,9,10-tetracarboxydiimido,

N,N'-di(3,5-dipentylphenyl)perylene-3,4,9,10-tetracarboxydiimido,

N,N'-di(3,5-dihexylphenyl)perylene-3,4,9,10-tetracarboxydiimido and the like, especially N,N'-di(3,5-dimethylphenyl)perylene-3,4,9,10-tetracarboxydiimido is preberable.

The charge-transferring ingredient utilized in the invention is diamine derivative represented by the general formula (II) set forth in the above, wherein the low alkyl group contains methyl, ethyl, propyl, isopropyl, butyl, isobutyl, tertbutyl, penthyl and hexyl and the like having 1 to 6 carbon atoms, preferably having 1 to 4 carbon atoms, the alkoxy group contains methoxy, ethoxy, propoxy, butoxy, isobutoxy, tert-butoxy, pentyloxy, hexyloxy and the like having from 1 to 6 carbon atom(s), preferably having from 1 to 4 carbon atoms, and the halogen atom contains respectively fluorine atom, chlorine atom and iodine atom.

Examples of the compound represented by the general formula (II) are following.

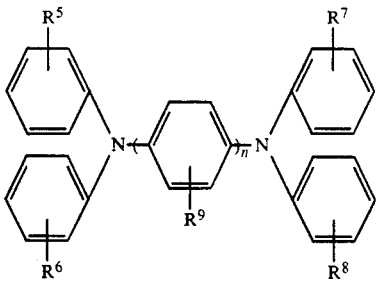

(IIa)

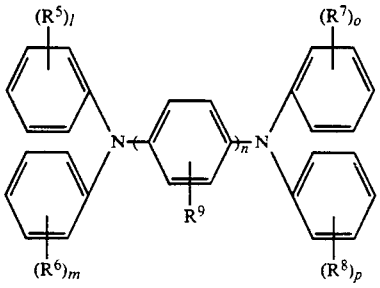

(IIb)

wherein $R^5$, $R^6$, $R^7$, $R^8$ and $R^9$ are the same or different, hydrogen atom, lower alkyl group, lower alkoxy group or halogen atom, l, m, o and p are integers from 0 to 2, n is an integer from 1 to 3, provided that $R^5$, $R^6$, $R^7$ and $R^8$ are not simultaneously hydrogen atom, and at least one of the l, m, n and p of $R^5$, $R^6$, $R^7$ and $R^8$ which is not a hydrogen atom is 2.

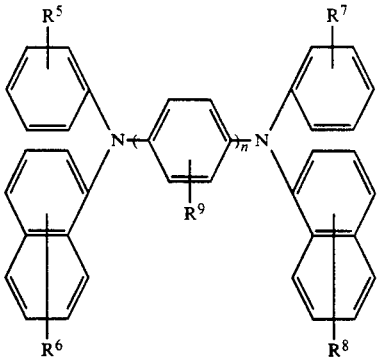

(IIc)

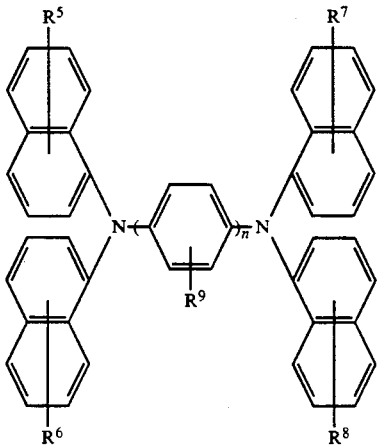

(IId)

The diamine derivative represented by the general formula (IIa), wherein including p-phenylenediamine derivative of n=1, preferable compound thereof is for instance 1,4-bis(N,N'-diphenylamino)benzene, 1-(N,N-diphenylamino)-4-[N-(3-methylphenyl)-N-phenylamino]benzene, 1,4-bis[N-(3-methylphenyl)N-phenylamino]benzen, and the like, and the diamine derivative other than that mentioned above is described in Page 13 to 20 of Japanese Patent Applicaton No. 277158/1987.

Diamine derivative represented by the general formula (IIa), wherein including benzidine derivative of n=2. preferable compound thereof is for instance, 4,4'-bis(N,N'-diphenylamino)diphebyl, 4,4'-bis[N-(3-methylphenyl)-N-phenylamino]diphenyl, 4,4'-bis[N-(3-methoxyphenyl)-N-phenylamino]diphenyl, 4,4'-bis[N-(3-chlorophenyl)-N-phenylamino]diphenyl, 4-[N-(2-methylphenyl)-N-phenylamino]-4'-[N-(4-methylphenyl)-N-phenylamino]diphenyl, 4-[N-(2-methylphenyl)-N-phenylamino]-4'-[N-(3-methylphenyl)-N-phenylamino]diphenyl, 3,3'-dimethyl-4,4'-bis[N,N'-di(4-methylphenyl)amino]-biphenyl, 3,3'-diethyl-4,4'-bis[N,N'-di(4-methylphenyl)amino]-biphenyl, and the like, and the diamine other than that mentioned above is described in Page 21 to 28 of Japanese Patent Application No. 277158/1987.

The diamine derivatives represented by general formula (IIa), wherein including 4,4'-terphenyldiamine derivative of n=3, preferable compound thereof is for instance, 4,4''-bis(N,N-diphenylamino)-1,1':4', 1''-terphenyl, 4,4''-bis[N-(3-methylphenyl)-N-phenylamino]-1,1':4', 1''-terphenyl, and the diamine derivative other than that mentioned above is described in page 28 to 34 of Japanese Patent Application No. 277158/1987.

The compounds represented by the general formula (IIa) containes the most preferable diamine derivative which is 3,3'dimethyl-4,4'-bis[N,N-di(4-methylphenyl-)amino]biphenyl, represented by the following general formula (III);

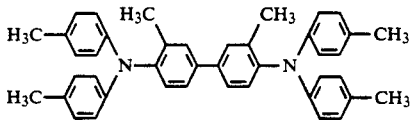

(III)

The diamine derivative of the invention represented by general formula (IIb) wherein including p-phenylenediamine derivative of n=1, preferable compound is for instance, 1-[N-(3,5-dimethylphenyl)-N-phenylamino]-4-(N,N-diphenylamino)benzene, 1-[N,N-di(3,5-dimethylphenyl)amino]-4-(N,N-diphenylamino)benzene, 1,4-bis[N-(3,5-dimethylphenyl)-N-phenylamino]benzene and the like, and the diamine derivative other than that mentioned above is described in Page 13 to 21 of Japanese Patent Application No. 277159/1987.

The diamine derivative represented by general formula (IIb), wherein including benzidine derivative of n=2, preferable compound is for instance 4,4-bis[N-(3,5-dimethylphenyl)-N-phenylamino]diphenyl, 4,4-bis[N-(3,5-dimethoxyphenyl)-N-phenylamino]-diphenyl,
4,4-bis[N-(3,5-dichlorophenyl)-N-phenylamino]diphenyl,
4,4-bis[N-(3,5-dimethylphenyl)-N-(3-methylphenyl-)amino]diphenyl,
4-[N-(2,4-dimethylphenyl)-N-phenylamino]-4'-[N-(3,5-dimethylphenyl)-N-phenylamino]diphenyl and the like, and the diamine derivative other than that mentioned above is described in Page 21 to 29 of Japanese Patent Application No. 277159/1987.

The diamine derivative represented by general formula (IIb), wherein including 4,4''-terphenyldiamine derivative of n=3, preferable compound thereof is for instance, 4,4''-bis[N-(3,5-dimethylphenyl)-N-phenylamino]1,1':-4',1''-terpheny,
4-[N-(3,5-dimethylphenyl)-N-phenylamino]-4''-(N,N-diphenylamino)-1,1':4',1''-terphenyl,
4-[N,N-bis(3,5-dimethylphenyl)amino]-4''-(N,N-diphenylamino)-1,1':4',1''-terphenyl and the like, and the diamine derivatives thereof other than that mentioned above are described in Page 29 to 36 of Japanese Patent Application No. 277159/1987.

The diamine derivative represented by general formula (IIc), wherein including phenylenediamine derivative of n=1, preferable compound thereof is for instance, 1,4-bis[N-(6-methylnaphthyl)-N-phenylamino]benzene,
1,4-bis(N-naphthyl-N-phenylamino)benzene,
1-(N-naphthyl-N-phenylamino)-4-[N-(6-methylnaphthyl)-N-phenylamino]benzene and the like, and the diamine derivative thereof other than mentioned above is described in Page 13 to 19, Japanese Patent Application No. 277161/1987.

The diamine derivative represented by general formula (IIc), wherein including benzidine derivative of n=2, preferable compound thereof is for instance, 4,4'-bis(N-naphthyl-N-phenylamino)diphenyl,
4,4'-bis[N-(6-methylnaphthyl)-N-phenylamino]diphenyl,
4,4'-bis[N-(6-methoxynaphthyl)-N-phenylamino]diphenyl,
4,4'-bis[N-(6-chloronaphthyl)-N-phenylamino]diphenyl,
4,4'-bis[N-(6-methylnaphthyl)-N-(3-methylphenyl-)amino]diphenyl,
4-[N-(6-methylnaphthyl)-N-phenylamino]4'-[N-(6-methylnaphthyl)-N-(3-methylphenyl)amino]diphenyl,
4-[N-(4-methylnaphthyl)-N-phenylamino]-4'-[N-(6-methylnaphthyl)-N-phenylamino]diphenyl and the like, and the diamine derivative thereof other than that mentioned above is described in Page 19 to 25, Japanese Patent Application No. 277161/1987.

The diamine derivative represented by general formula (IIc), wherein including 4,4''-terphenyldiamine derivative of n=3, preferable compound thereof is for instance, 4,4''-bis(N-naphthyl-N-phenylamino)-1,1':4',1''-terphenyl,
4,4'-bis[N-(6-methylnaphthyl)-N-phenylamino]-1,1':4',1''-terphenyl and the like, and the diamine derivative thereof other than that mentioned above is described in Page 25 to 30, Japanese Patent Application No. 277161/1987.

And diamine derivative represented by general formula (IId), wherein including p-phenylenediamine of n=1, preferable compound thereof is for instance, 1,4-bis(N,N-dinaphthylamino)benzene,
1-(N,N-dinaphthylamino)-4-[N-(6-methylnaphthyl)-N-naphthylamino]benzene,
1,4-bis[N-(6-methylnaphthyl)-N-naphthylamino]benzene and the like, and the diamine derivative thereof other than that mentioned above is described in Page 13 to 22, Japanese Patent Application No. 277162/1987.

The diamine derivative represented by general formula (IId), wherein including benzidine derivative of n=2, preferable compound thereof is for instance, 4,4'-bis[N,N-di(6-methylnaphthyl)amino]diphenyl,
4,4'-bis[N-(6-methylnaphthyl)-N-naphthylamino]diphenyl,
4,4'-bis[N-(6-methoxynaphthyl)-N-naphthylamino]-diphenyl,
4,4'-bis[N-(6-chloronaphthyl)-N-naphthylamino]diphenyl,
4-[N,N-di(6-methylnaphthyl)amino]-4'-[N-(6-methylnaphthyl)-N-naphthylamino]diphenyl,
4-[N-(4-methylnaphthyl)amino-N-naphthylamino]-4'-[N-(6-methylnaphthyl)-N-naphthylamino]diphenyl and the like, and the diamine derivative thereof other than that mentioned above is described in Page 22 to 30 of Japanese Patent Application No. 277162/1987.

The diamine derivative represented by general formula (IId), wherein including 4,4''-terphenyldiamine derivative of n=3, preferable compound thereof is for instance, 4,4''-bis(N,N-dinaphthylamino)-1,1':4',1''-terphenyl, 4,4''-bis[N-(6-methylnaphthyl)-N-naphthylamino]-1,1':4',1''-terphenyl and the like, and the diamine derivative other than that mentioned above is described in Page 30 to 38 of Japanese Patent Application No. 277162/1987.

The diamine derivative represented by general formula (II) may be used either single or jointly in the form of a mixture of two or more members. And the diamine derivatives aforementioned are not only having symmetrical moliculer structure, taking no part in isomerization reaction caused by light irradiation and providing light stability but features showing large drift mobility and low electric field strength dependency.

Therefore, a high sensitive and small residual potential electrophotosensitive material, though it is a material having single type photosensitive layer, can be obtained combining the diamine derivative which have peculiarities mentioned above and perylene compound aforementioned.

The binding resin of the invention allows in applying various kind of polymerized materials wherein including styrene polymer, acryl-polymer, styrene-acryl polymer, polyethylen, ethylene-vinylacetate copolymer, olefine polymer such as chlorinated polyethylene, polypropylene, ionomer, etc., polyvinyl chloride, vinylchloride-vinylacetate copolymer, polyester, arkyd resin, polyamido, polyuretane, epoxy resin, polycarbonate, polyacrylate, polysuphone, diarylphthalate, silicon resin, ketonresin, polyvinyl-butylal resin, polyether resin, phenol resin and photohardening resin wherein including epoxyacrylate, however, most preferable polymerized material is poly(4,4'-cyclohexylidenediphenyl)carbonate because of the special features wherein providing wide selectivity for the solvent capable of dissolving the binding resin as well as increasing sensitivity of the photosensitive layer, promoting wear and abrasion resistance and reproducibility of the photosensitive layer.

The poly(4,4'-cyclohexylidenediphenyl)carbonate abovementioned allows tetrahydrofuran, methylethylketon, etc. to use as the solvent thereof recommendable from safety and healthy also handy points of view, which features completely differ from bisphenol-A-type-polycarbonate for which only chlorinated solvent such as dichloromethane, monochlorobenzene, etc. can be used.

The poly(4,4'-cyclohexylydenediphenyl)carbonate, it is preferabley having a molecular weight between 15,000 and 25,000 and 58° C. of glass transition point.

The mixing proportion the above mentioned perylene compound and diamine derivative, and the binding resin is not necessarily restricted and, according to the characteristics of the electrophotosensitive material, selected in an appropriate manner, however, general proportion in an electrophotosensitive material is 2 to 20 parts by weight of perylene compound preferably from 3 to 15 parts by weight of perylene compound and 40 to 20 weight part, preferably 50 to 100 parts by weight of the diamine derivatives to 100 parts by weight of binding resin. If the proporation of the perylene compound and the diamine derivative is smaller than above mentioned, then not only the photosensitivity of the sensitive material becomes insufficient but the residual potential increases, and if the proporation of the perylene compound and the diamine derivative exceed the proportion mentioned above, resistance to wear and abrasion of the photosensitive material comes insufficient.

Generally, a photosensitive material contained in excess of perylene compound is used allows the positive electrification to be insufficient, and if photosensitive material contained in too low, the sensitivity and other properties thereof is deteriorated. The photosensitive material of this invention is combining a specified perylene compound compound and diamine derivative and X-type metal-free phthalocyanine that, however proportion of the perylene compound in the combination contained thereof is small, the sensitivity and the surface potentialare kept high, the residual potential is small and the positive electrification becomes superb.

A preferable X-type metal-free phthalocyanine used in this invention is to have a strong analysis peak in Blagg scattering angle (2°±0.2°) of 7.5°, 9.1°, 16.7°, 17.3°, 22.3°. The photosensitive layer wherein containing X-type metal-free phthalocyanine added in the proportion of 1.25 to 3.75 parts by weight to 100 parts by weight of perylene compound allows the spectro-sensitivity range of the photosensitive material expanding to the long wave-length side and sensitivity level of the material being to high. However, if the photosensitive material containes X-type metal-free phthalocyanine in the renge of less than 1.25 parts by weight to 100 parts by weight of perylene compound, spectro-sensitivity of that is not spreaded to long wave-length side, conversely, if it contained X type metal free phtalocyanin in the range of over 3.75 parts by weight to 100 parts by weight of perylene compound, the spectro-sensitivity of it becomes too high to repoduce the red-original.

An antioxidant is capable of well resisting degradation of the electro-transferring ingredient wherein having a chemical structure affected easily from oxidizing.

The antioxidant aforementioned is include phenol antioxidants such as 2,6-di-tert-butyl-p-cresol, triethyleneglycol-bis[3-(3-tert-butyl-5-methyl-4-hydroxyphenyl)propyonate], 1,6-hexanediol-bis[3-(3,5-di-tert-butyl-4-hydroxyphenyl)propyonate], penthaerystyril-tetrakis[3-(3,5-di-tert-butyl-4-hydroxyphenyl)propyonate], 2,2-thio-diethylenebis[3-(3,5-di-tert-butyl-4-hydroxyphenyl)propyonate], 2,2-thiobis(4-methyl-6-tert-butylphenol), N,N'-hexamethylenebis(3-5-di-tert-butyl-4-hydroxyhydrocyanamido) and 1,3,5-trimethyl-2,4,6-tris(3,5'-di-tert-butyl-4-hydroxybenzil)benzene, preferably 2,6,-di-tert-butyl-p-cresol.

The photosensitive material in the invention is obtained by preparing the coating solution wherein containing each ingredients set forth in the above, coating onto an electro conductive substrate and drying.

The conductive substrate may be shaped in sheet or drum, and the material of conductive substrate is included various kind of conductive materials such as simple body of metal include almite-prossesing or not almite-prossesing aluminium, aluminium alloys, copper, tin, platinum, gold, silver, vanadium, molibudenum, chrome, cadomium, titanium, nickel, paradium, indium, stainless steel, brass; plastic or glass material formed layer of these metals abovementioned, indium oxide, tin oxide and the like by vapor deposition; preferable substrate is the material treated by anodic oxidation with sulfuric acid-almite method and sealed small holls on the surface with nickel acetate.

The conductive substrate may surfaced by a surface preparation agent such as silane couplings and titanium couplings to increase adhesion of the substrate and the photosensitive layer coated thereonto.

In preparation of the above coating solutions, various solvents may be used depending on the type of the binding resin and others to be used. Such examples of solvent may be include, alcohols such as methanol, ethanol, propanol, isopropanol, butanol and the like; paraffinic hydrocarbons such as n-hexan, octane and cyclohexane and the like; aromatic hydrocarbons such as benzene, toluene, xylene and the like; halogenated hydrocarbons such as dichloromethane, dichloroethane, carbon tetrachloride, chlorobenzene and the like; ethers such as tetrahydrofulane, ethyleneglycoldimethylether, ethyleneglycoldiethylether and the like; ketones such as acetone methylethylketone, cyclohexanone and the like; and esters such as ethyl acetate, methyl acetate and the like; and these are used either alone of in combination of two or more types. To increase dispersibility and workability of the coating solution, a surface active agent, and a leveling agent such as silicon oil, a sensitivity increasing agent such as those disclosed terphenyl, halonaphthoquinons and acenaphthylene may be applied, preferable silicon oil is polydimethylsiloxane.

The preparing the coating solution, conventional method of mixing and dispersing may be applied, such as paint shaker, mixer, ball mill, sand mill, atriter, and ultrasonic dispersion machine, and to paint the coating solution, those of conventional method may be applied, such as dip-coating, spray-coating, spin-coating, roller-coating, blade-coating, curtain-coating and bar-coating.

The thickness of the single layer type photosensitive material in this invention may be adequate, preferably 15 to 30 μm, more preferably 18 to 27 μm.

Thus, the electrophotosensitive material of this invention gives a high sensitivity and surface potential, moreover, shows small residual potentials, though it is sensitive monolayer, as well as providing special features of superior positive electrification and good performance of copying red-color.

EXAMPLES

The present invention is described more specificially below with examples.

EXAMPLE 1

100 parts by weight of poly-(4,4'-cyclohexylidendiphenyl)carbonate (produced by Mitsubishi gas kagaku K.K.; Brand name: Policarbonate Z), 8 parts by weight of N,N'-di(3,5-dimethylphenyl)perylene-3,4,9,10-tetracarboxydiimido, 0.2 parts by weight of X-type metal-free phthalocyanine (produced by Dainihon Ink K.K.), 100 parts by weight of 3,3'-dimethyl-4,4'-bis[N,N-di(4-methylphenyl)amino]biphenyl, 0.01 parts by weight of polydimethylsiloxane (produced by Shinetsu Kagaku K.K.) and a definite quantity of tetrahydrofuran was mixed and dispersed by a ultrasonic dispersion apparatus and applied to the alumited aluminium substrate pipe to form 23 μm of photosensitive layer and heated at 100° C. to produce electrophotosensitive material.

EXAMPLE 2

There was prepared single-layer type electrophotosensitive material in the same manner as that of Example 1, excepting that 0.1 parts by weigh of X-type metal-free phthalocyanine (produced by Dainihon Ink K.K.).

EXAMPLE 3

There was prepared single-layer type electrophotosensitive material in the same manner as that of Example 1, excepting that 0.3 parts by weigh of X-type metal-free phthalocyanine (produced by Dainihon Ink K.K.) was used.

EXAMPLE 4

There was prepared the electrophotosensitive material having the photosensitive layer in the thikness of 23 μm, in the same manner as Example 1, excepting that 3,3'-diethyl-4,4'-bis[N,N-di(4-methylphenyl)amino]-biphenyl was used in the place of 3,3'-dimethyl-4,4'-bis[N,N-di(4 methylphenyl)amino]biphenyl, silicone oil (produced by Shinetsu Kagaku K.K.) was used in the place of polydimethylsiloxiane.

EXAMPLE 5

There was prepared the electrophotosensitive material in the same manner as Example 4, excepting that 100 parts by weight of 4,4'-bis[N-(3,5-dimethylphenyl)-N-phenylamino]biphenyl was used in the place of 3,3'-diethyl-4,4'-bis[N,N'-(4-methylphenyl)amino]biphenyl.

EXAMPLE 6

There was prepared the electrophotosensitive material in the same manner as Example 4, excepting that 100 parts by weight of 4,4'-bis[N-bis(6-methylnaphtyl)-N-naphtylamino]biphenyl was used in the place of 3,3'-diethyl-4,4'-bis[N,N-di(4-methylphenyl)amino]biphenyl.

EXAMPLE 7

There was prepared the electrophotosensitive material in the same manner as Example 4, excepting that 100 parts by weight of 4,4'-bis[N-(6-methylnaphtyl)-N-naphtylamino]biphenyl was used in the place of 3,3'-diethyl-4,4'-bis[N,N-di(4-methylphenyl)amino]biphenyl.

EXAMPLE 8

There was prepared the electrophotosensitive material in the same manner as that of Example 4, excepting that 0.05 parts by weigh of X-type metal-free phthalocyanine (produced by Dainihon Ink K.K.) was used.

EXAMPLE 9

There was prepared the electrophotosensitive material in the same manner as that of Example 4, excepting that 0.4 parts by weigh of X-type metal-free phthalocyanine (produced by Dainihon Ink K.K.) was used.

EXAMPLE 10

There was prepared single-layer type electrophotosensitive material in the same manner as that of Example 1, excepting that 0.05 parts by weigh of X-type metal-free phthalocyanine (produced by Dainihon Ink K.K.) was used.

EXAMPLE 11

There was prepared single-layer type electrophotosensitive material in the same manner as that of Example 1, excepting that 0.4 parts by weigh of X-type metal-free phthalocyanine (produced by Dainihon Ink K.K.) was used.

COMPARATIVE EXAMPLE 1

There was prepared single-layer type electrophotosensitive material in the same manner as that of Example 1, excepting that 0.2 parts by weight of β-type metal-free phthalocyanine was used in the place of 0.2 parts by weight of X-type metal-free phthalocyanine.

COMPARATIVE EXAMPLE 2

There was prepared single-layer type electrophotosensitive material in the same manner as that of Example 1, excepting that 0.6 parts by weight β-type metal-free phthalocyanine was used in the place of X-type metal-free phthalocyanine.

COMPARATIVE EXAMPLE 3

There was prepared the electrophotosensitive material in the same manner as Example 4, excepting that 100 parts by weight of N-ethyl-3-carbazolylaldehide-N,N-diphenylhydrazon was used in the place of 3,3'-diethyl-4,4'-bis[N,N-di(4-methylphenyl)amino]biphenyl.

COMPARATIVE EXAMPLE 4

There was prepared single-layer type electrophotosensitive material in the same manner as that of Example 4, excepting that 0.2 parts by weight of β-type metal-free phthalocyanine was used in the place of X-type metal-free phthalocyanine.

To test for charging property and sensitive property, the electrophotosensitive materials obtained in Example 1 to 9 and Comparative Example 1 to 4 were each positive charged by an electrostatic test copier (produced by Gentek Company; Gentek Cincia 30M), then the surface potential: V s.p. (V), of each electrophotosensitive material was measured. At the same time, the surface of the electrophotosensitive material was exposed to light from a tungsten lamp of 10 luxes to clock the time required for the aforementioned surface potential:

V s.p., to decrease to ½ the initial magnitude and calculated the half-life exposure: E ½ ($\mu J/cm^2$). The surface potential measured on elapse of 0.15 second following the exposure was reported as residual potential: V r.p. (V).

The reflection density of a red color was calculated, by copying a gray coloured original having the same reflection density of a red coloured original, and calculating following expression:

$$\frac{\text{the reflection density of copy}}{\text{the reflection density of gray coloued original}} \times 100$$

and estimated the copying performance of red colour.

The value obtained in above mentioned expression was evaluated with "X" for that less than 70%, and "Δ" for that in the range of 70 to 100% and "O" for that over 100%.

The result of the above mentioned tests of the electrophotosensitive materials obtained in Example 1 to 11 and Comparative Example 1 to 4 for charging property and sensitive property and the like, are shown in the Table 1.

TABLE 1

| | Vs.r. (V) | E ½ ($\mu J/cm^2$) | Vr.p. (V) | Copying performance of red-color |
|---|---|---|---|---|
| Example 1 | 700 | 18.0 | 70 | ○ |
| Example 2 | 705 | 22.0 | 90 | ○ |
| Example 3 | 710 | 16.5 | 70 | ○ |
| Example 4 | 705 | 18.5 | 75 | ○ |
| Example 5 | 700 | 19.5 | 80 | ○ |
| Example 6 | 705 | 20.5 | 90 | ○ |
| Example 7 | 715 | 21.0 | 85 | ○ |
| Example 8 | 710 | 19.5 | 80 | ○ |
| Example 9 | 690 | 16.5 | 65 | X |
| Example 10 | 705 | 23.5 | 95 | ○ |
| Example 11 | 695 | 15.5 | 65 | X |
| Comparative example 1 | 700 | 25.5 | 105 | ○ |
| Comparative example 2 | 700 | 19.5 | 80 | X |
| Comparative example 3 | 710 | 24.0 | 95 | ○ |
| Comparative example 4 | 695 | 21.5 | 100 | ○ |

The data in Table 1 demonstrate that the electrophotosensitive materials of the Example 1 to 8 and 10 respectively excel in electrification characteristics and having a high sensivity and low residual potential, moreover provide good copying performance of red-color. The electrophotosensitive materials of the Example 8, 9 and 11 are also superior in electrification characteristics and have high sensitivity and low residual potential.

The electrophotosensitive material of the Comparative Example 1, 3 and 4 show inferior sensitivity and excessive residual potential though the materials excel in copying performance of red-colore. The electrohotosensitive material of the Comparative Example 2 shows inferior in the copying performance of red-color.

What is claimed is:

1. An electrophotosensitive material comprising a conductive substrate and a photosensitive layer formed thereon, the photosensitive layer including charge-generating ingredients and a charge-transferring ingredient in a binding resin, said charge-generating ingredients being a perylene compound represented by the following general formula (I):

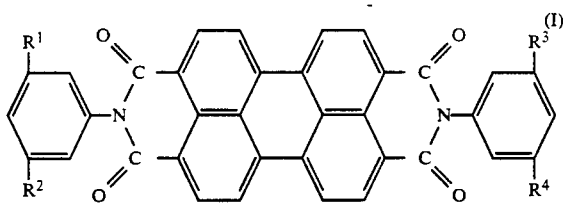

(I)

wherein $R^1$, $R^2$, $R^3$ and $R^4$ are the same or different, lower alkyl group substituent, and an X-type metal-free phthalocyanine present in the amount of 1.25 to 3.75 parts by weight phthalocyanine to 100 parts by weight of the perylene compound, said charge-tranferring ingredient being a diamine derivative represented by the following general formula (II):

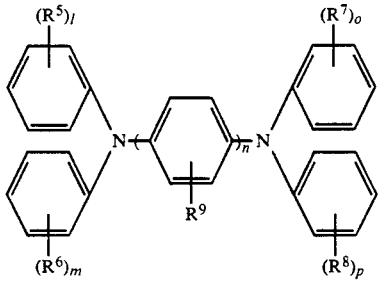

(II)

wherein $R^5$, $R^6$, $R^7$, $R^8$ and $R^9$ are the same or different, selected from the group consisting of hydrogen atoms, lower alkyl group, lower alkoxy group or halogen atoms, n is an integer from 1 to 3, l, m, o and p are integers from 0 to 2, at least one selected from the group consisting of following:

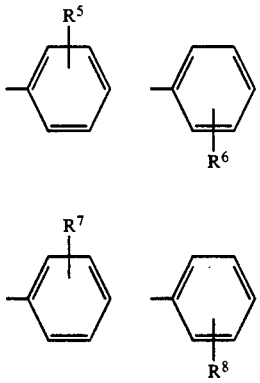

which may form a condensed ring with a benzene ring, which may have a lower alkyl group, lower alkoxy group or halogen atom as the substituent.

2. The electrophotosensitive material of claim 1, wherein the diamine derivative is represented by the following general formula (IIa):

(IIa)

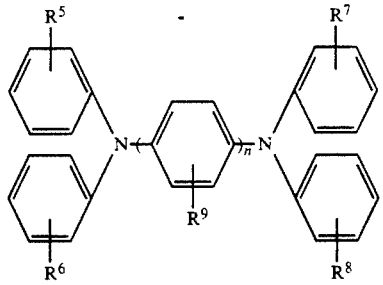

wherein $R^5$, $R^6$, $R^7$, $R^8$ and $R^9$ are the same or different, selected from the group consisting of hydrogen atoms, lower alkyl group, lower alkoxy group or halogen atoms, and n is an integer from 1 to 3.

3. The electrophotosensitive material of claim 1, wherein the diamine derivative is represented by the following general formula (IIb):

(IIb)

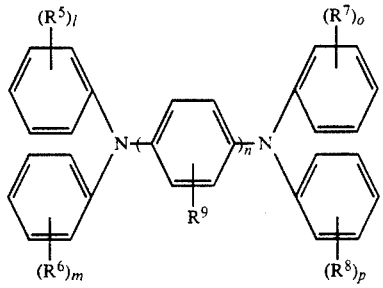

wherein $R^5$, $R^6$, $R^7$, $R^8$ and $R^9$ are the same or different, selected from the group consisting of hydrogen atoms, lower alkyl group, lower alkoxy group or halogen atoms, and l, m, o and p are integers from 0 to 2, and n is an integer from 1 to 3, provided that, $R^5$, $R^6$, $R^7$ and $R^8$ are not simultaneously hydrogen atoms, and at least one of the l, m, o and p of $R^5$, $R^6$, $R^7$ and $R^8$, respectively, which is not a hydrogen atom is 2.

4. The electrophotosensitive material of claim 1, wherein the diamine derivative is represented by the following general formula (IIc):

(IIc)

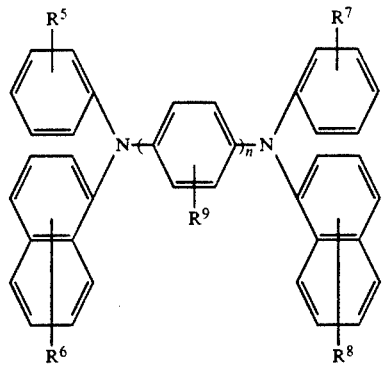

wherein $R^5$, $R^6$, $R^7$, $R^8$ and $R^9$ are the same or different, selected from the group consisting of hydrogen atoms, lower alkyl group, lower alkoxy group or halogen atoms, and n is an integer from 1 to 3.

5. The electrophotosensitive material of claim 1, wherein the diamine derivative is represented by the following general formula (IId):

(IId)

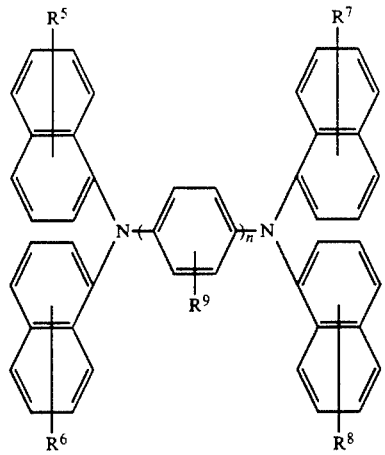

wherein $R^5$, $R^6$, $R^7$, $R^8$ and $R^9$ are the same or different, selected from the group consisting of hydrogen atoms, lower alkyl group, lower alkoxy group or halogen atoms, and n is an integer from 1 to 3.

6. The electrophotosensitive material of claim 1, wherein the photosensitive layer contains an antioxidant.

7. The electrophotosensitive material as described in claim 1, wherein the perylene compound is N,N'-bis(3,5-dimethylphenyl)perylene-3,4,9,10-tetracarboxydiimido.

8. The electrophotosensitive material of claim 1, wherein $R^5$, $R^6$, $R^7$, $R^8$ and $R^9$ are the same or different, selected from the group consisting of alkyl group having 1 to 4 carbon atoms, alkoxy group having 1 to 4 carbon atoms or halogen atoms.

9. The electrophotosensitive material of claim 1 wherein the diamine derivative is 3,3'-diethyl-4,4'-bis[N,N-di(4-methylphenyl)amino]biphenyl.

10. The electrophotosensitive material of claim 2, wherein the diamine derivative is 4,4'-bis[N-(3,5-dimethylphenyl)-N-phenylamino]biphenyl.

11. The electrophotosensitive material of claim 3, wherein the diamine derivative is 4,4'-bis[N-(6-methylnaphtyl)-N-phenylamino]biphenyl.

12. The electrophotosensitive material of claim 4, wherein the diamine derivative is 4,4'-bis[N-(6-methylnaphtyl)-N-naphtylamino]biphenyl.

13. An electrophotosensitive material comprising a conductive substrate and a photosensitive layer formed thereon, the photosensitive layer including charge-generating ingredients and a charge-transferring ingredient in a binding resin, said charge-generating ingredients being a perylene compound represented by the following general formula (I):

(I)

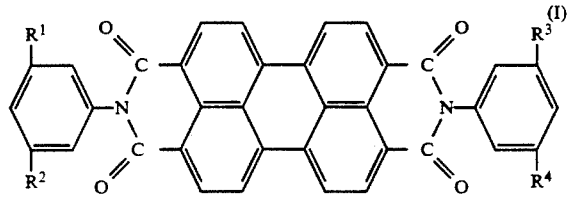

wherein $R^1$, $R^2$, $R^3$ and $R^4$ are the same or different, lower alkyl group, and an X-type metal-free phthalocyanine present in the amount of 1.25 to 3.75 parts by weight phthalocyanine to 100 parts by weight of perylene compound, said charge-transferring ingredient being 3,3'-dimethyl-4,4'-bis[N,N-di(4-methylphenyl)amino]biphenyl.

14. A process for imaging, comprising: exposing an electrophotosensitive material to light reflected from an original, wherein the improvement comprises:

providing the electrophotosensitive material which includes a conductive substrate and a photosensitive layer formed thereon, the photosensitive layer including charge-generating ingredients and a charge-transferring ingredient in a binding resin, said charge-generating ingredients being a perylene compound represented by the following general formula (I):

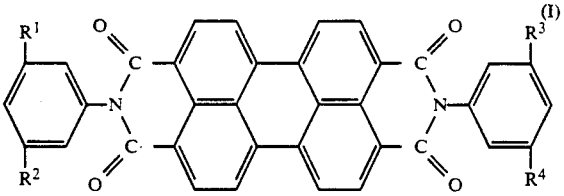

(I)

wherein $R^1$, $R^2$, $R^3$ and $R^4$ are the same or different, lower alkyl group substituent, and an X-type metal-free phthalocyanine present in the amount of 1.25 to 3.75 parts by weight phthalocyanine to 100 parts by weight of the perylene compound, said charge-transferring ingredient being a diamine derivative represented by the following general formula (II):

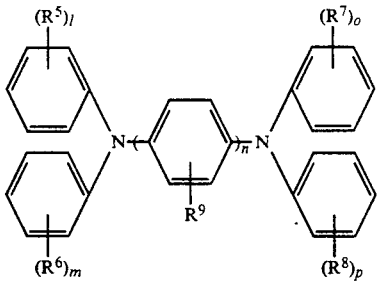

(II)

wherein $R^5$, $R^6$, $R^7$, $R^8$ and $R^9$ are the same or different, selected from the group consisting of hydrogen atoms, lower alkyl group, lower alkoxy group or halogen atoms, n is an integer from 1 to 3, l, m, o and p are integers from 0 to 2, at least one selected from the group consisting of following:

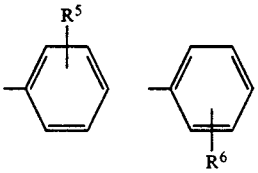

-continued

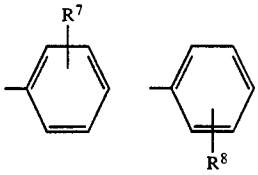

which may form a condensed ring with a benzene ring, which may have a lower alkyl group, lower alkoxy group or halogen atom as the substituent.

15. The process for imaging according to claim 14, wherein the diamine derivative in the electrophotosensitive material is represented by the following general formula (IIa):

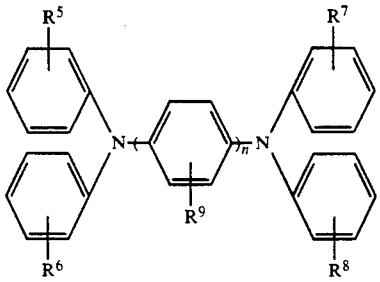

(IIa)

wherein $R^5$, $R^6$, $R^7$, $R^8$ and $R^9$ are the same or different, selected from the group consisting of hydrogen atoms, lower alkyl group, lower alkoxy group or halogen atoms, and n is an integer from 1 to 3.

16. The process for imaging according to claim 14, wherein the diamine derivative in the electrophotosensitive material is represented by the following general formula (IIb):

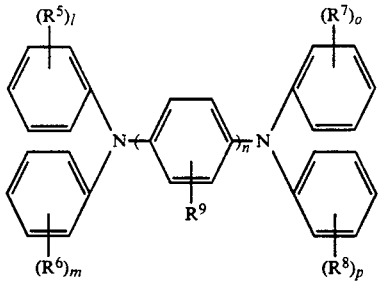

(IIb)

wherein $R^5$, $R^6$, $R^7$, $R^8$ and $R^9$ are the same or different, selected from the group consisting of hydrogen atoms, lower alkyl group, lower alkoxy group or halogen atoms, and l, m, o and p are integers from 0 to 2, and n is an integer from 1 to 3, provided that, $R^5$, $R^6$, $R^7$ and $R^8$ are not simultaneously hydrogen atoms, and at least one of the l, m, o and p of $R^5$, $R^6$, $R^7$ and $R^8$, respectively, which is not a hydrogen atom is 2.

17. The process for imaging according to claim 14, wherein the diamine derivative in the electrophotosensitive material is represented by the following general formula (IIc):

(IIc)

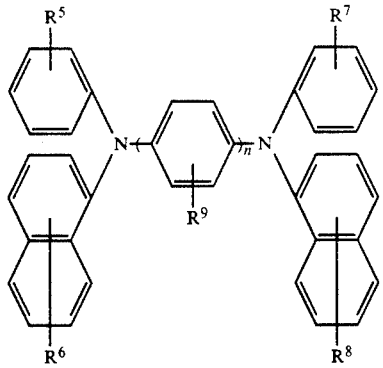

wherein $R^5$, $R^6$, $R^7$, $R^8$ and $R^9$ are the same or different, selected from the group consisting of hydrogen atoms, lower alkyl group, lower alkoxy group or halogen atoms, and n is an integer from 1 to 3.

18. The process for imaging according to claim 14, wherein the diamine derivative in the electrophotosensitive material is represented by the following general formula (IId):

(IId)

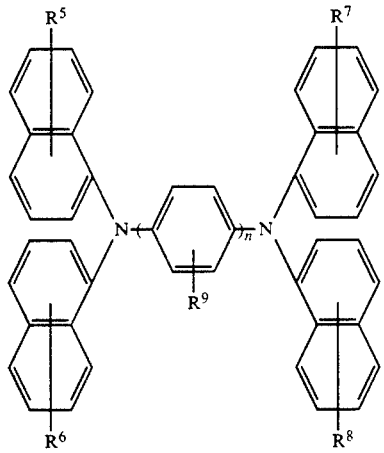

wherein $R^5$, $R^6$, $R^7$, $R^8$ and $R^9$ are the same or different, selected from the group consisting of hydrogen atoms, lower alkyl group, lower alkoxy group or halogen atoms, and n is an integer from 1 to 3.

19. The process for imaging according to claim 14, wherein in the electrophotosensitive material, $R^5$, $R^6$, $R^7$, $R^8$ and $R^9$ are the same or different, selected from the group consisting of alkyl group having 1 to 4 carbon atoms, alkoxy group having 1 to 4 carbon atoms or halogen atoms.

20. The process for imaging according to claim 14, further comprising the step of forming a copy conforming to the original from the electrophotosensitive material.

21. The process for imaging according to claim 14, wherein the perylene compound of the electrophotosensitive material is N,N'-bis(3,5-dimethylphenyl)perylene-3,4,9,10-tetracarboxydiimido.

22. The process for imaging according to claim 14, wherein the diamine derivative of the electrophotosensitive material is 3,3'-diethyl-4,4'-bis[N,N-di(4-methylphenyl) amino]biphenyl.

23. The process for imaging according to claim 15, wherein the diamine derivative of the electrophotosensitive material is 4,4'-bis[N-(3,5-dimethylphenyl)amino]-biphenyl)-N-phenylamino]biphenyl.

24. The process for imaging according to claim 16, wherein the diamine derivative of the electrophotosensitive material is 4,4'-bis[N-(6-methylnaphtyl)-N-phenylamino]biphenyl.

25. The process for imaging according to claim 17, wherein the diamine derivative of the photosensitive material is 4,4'-bis[N-(6-methylnaphtyl)-N-naphtylamino]biphenyl.

26. A method of using an electrophotosensitive material in an image forming process, comprising: forming an image on a copy of an original, wherein the electrophotosensitive material includes a conductive substrate and a photosensitive layer formed thereon, the photosensitive layer including charge-generating ingredients and a charge-transferring ingredient in a binding resin, said charge-generating ingredients being a perylene compound represented by the following general formula (I):

(I)

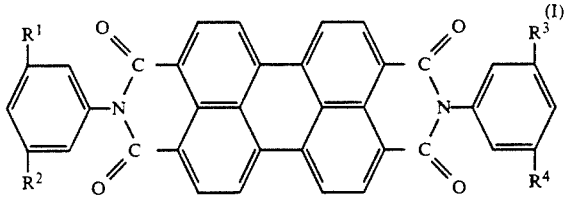

wherein $R^1$, $R^2$, $R^3$ and $R^4$ are the same or different, lower alkyl group, and an X-type metal-free phthalocyanine present in the amount of 1.25 to 3.75 parts by weight phthalocyanine to 100 parts by weight of perylene compound, said charge-transferring ingredient being a diamine derivative represented by the following general formula (II):

(II)

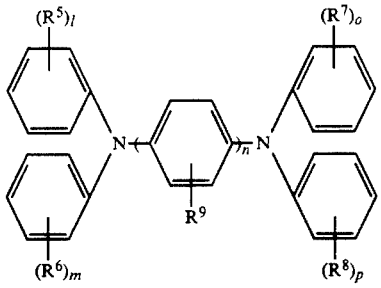

wherein $R^5$, $R^6$, $R^7$, $R^8$ and $R^9$ are the same or different, selected from the group consisting of hydrogen atoms, lower alkyl group, lower alkoxy group or halogen atoms, n is an integer from 1 to 3, l, m, o and p are integers from 0 to 2, at least one selected from the group consisting of following:

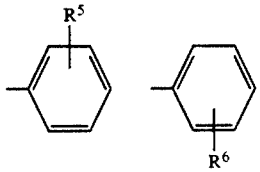

-continued
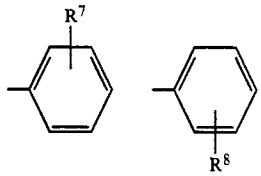
which may form a condensed ring with a benzene ring, which may have a lower alkyl group, lower alkoxy group or halogen atom as the substituent.
* * * * *